United States Patent [19]

Senor

[11] 3,959,762

[45] May 25, 1976

[54] THERMALLY RESPONSIVE ELECTRICAL SWITCH

[75] Inventor: Ronald E. Senor, North Attleboro, Mass.

[73] Assignee: Texas Instruments Incorporated, Dallas, Tex.

[22] Filed: Dec. 9, 1974

[21] Appl. No.: 530,630

[52] U.S. Cl. ..... 337/102; 337/89; 337/377

[51] Int. Cl.[2] ..... H01H 61/02

[58] Field of Search ..... 337/89, 102, 103, 104, 337/377; 339/111; 200/144 B; 174/52 GM

[56] References Cited

UNITED STATES PATENTS

| | | | |
|---|---|---|---|
| 2,458,748 | 1/1949 | Stupakoff | 174/152 GM |
| 3,453,577 | 7/1969 | D'Entremont | 337/89 |
| 3,602,862 | 8/1971 | D'Entremont | 337/104 |

*Primary Examiner*—Harold Broome
*Attorney, Agent, or Firm*—John A. Haug; James P. McAndrews; Russell E. Baumann

[57] ABSTRACT

A thermostatic switch with a compact design to allow for miniaturization of the device with a minimum number of parts while providing for accurately controlled "on" time and protracted "off" time. An improved heater and thermostatic disk assembly overcomes yield problems associated with prior art devices in mass producing the switch.

9 Claims, 8 Drawing Figures

THERMALLY RESPONSIVE ELECTRICAL SWITCH

BACKGROUND AND SUMMARY OF INVENTIONF

This invention relates to thermally responsive electrical switches and more particularly to small, compact switches which are useful as overload protectors.

Past designs of thermally responsive electrical switches employing heater and thermostatic disk assemblies such as described in U.S. Pat. Nos. 3,194,924 and 3,104,296 assigned to the assignee of the present application have been successful and particularly well suited for protective use in connection with electrical apparatus such as encountered in motors and the like. However, tight response tolerance in present designs of motors and the like require devices with precisely controllable "on" times that can be mass produced and protracted "off" times compared to those prior art switches to allow the motor to cool sufficiently before resetting of the protective switch allowing restarting of the motor.

It is an object of this invention to provide a switch which is reliable in operation, has a minimum number of components and has a minimum amount of complexity.

It is another object of this invention to provide a thermostatic switch which is compact and therefore adapted for miniaturization so as to be conveniently inserted into the small spaces directly adjacent the heated parts of motors and the like.

It is another object of this invention to provide a thermostatic switch with a precisely controllable "on" time and a protracted "off" time.

It is yet another object of this invention to provide a thermostatic switch which is adapted for inexpensive manufacture.

It is still another object of this invention to provide a switch which is easily and simply calibrated.

Other objects will be in part apparent and in part pointed out hereinafter.

The invention accordingly comprises the elements and combinations of elements, features of construction and arrangement of parts which will be exemplified in the structures hereinafter described, and the scope of the application of which will be indicated in the following claims.

In the accompanying drawings, in which one of various possible embodiments of the invention are illustrated:

Similar reference characters indicate corresponding parts throughout the several views of the drawings.

Figure 1:
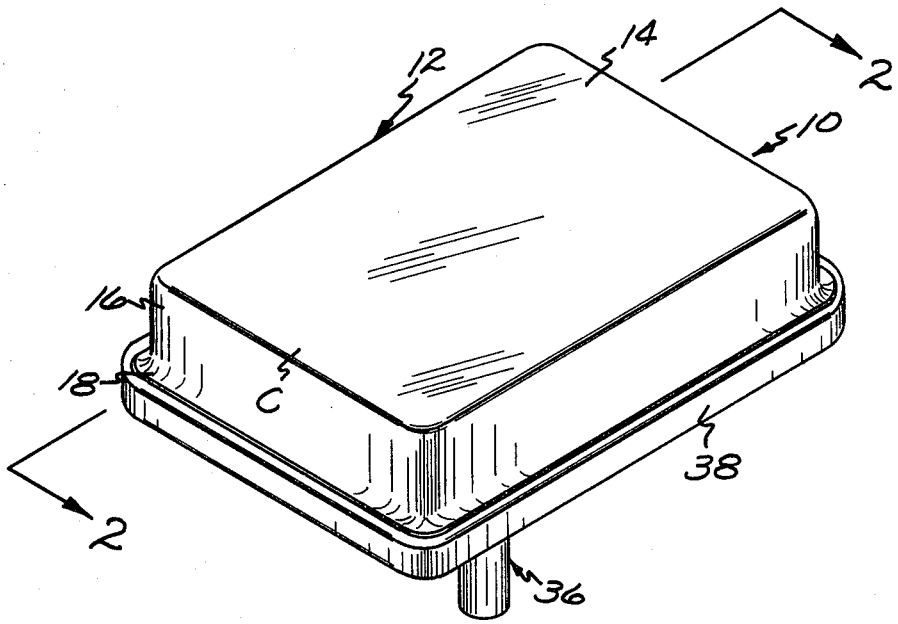
FIG. 1 is a perspective view of a switch made in accordance with the invention.
Figure 2:
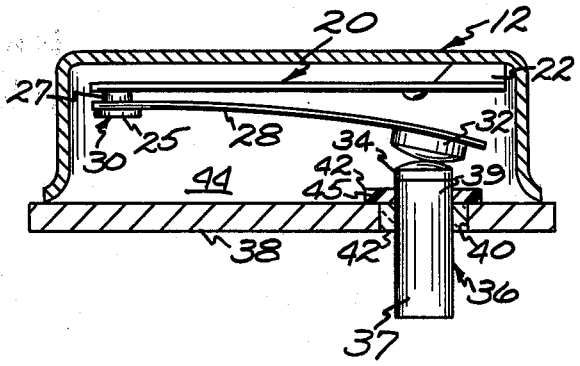
FIG. 2 is a sectional view of the switch illustrated in FIG. 1 taken on line 2—2 of FIG. 1 with the contacts in the closed position.
Figure 3:
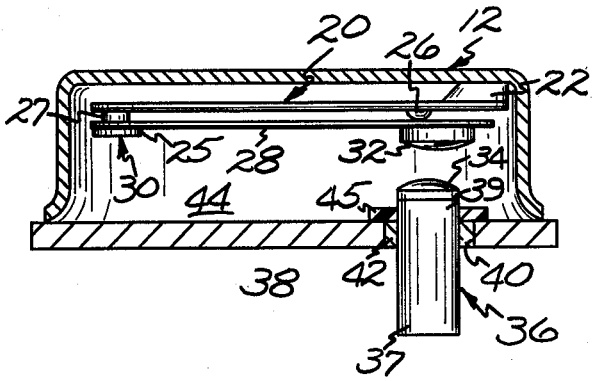
FIG. 3 is a view similar to FIG. 2 with the contacts in the open position.

Referring now to the drawings, there is shown in FIGS. 1–3, a heat and current sensitive thermally responsive switching device generally referred to by numeral 10. Switch 10 comprises a metallic electrically and thermally conductive housing or can 12 as best shown in FIG. 1. Can 12 may be conveniently formed generally as a parallelepiped with a close ended top portion 14, with side walls 16, and an open ended bottom portion through which is inserted a thermally responsive switching assembly which will be discussed in detail below. The lower section of the side walls 16 are flared out to form a rim 18 around the perimeter of can 12. An example of a suitable material for the can is steel for its weldability and inexpensiveness.

Figure 4:
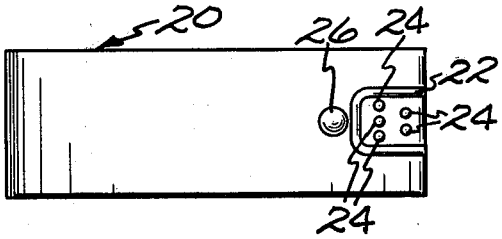
FIG. 4 is a bottom plan view of a heater element used in the switch of FIGS. 1–3.

A main winding heater element 20 as best shown in FIG. 4 may be formed from a sheet of material and is generally an elongated rectangle in plan view with a first end adapted to be fixed in the device and a second opposite end adapted to be free. The fixed end preferably has a raised or embossed portion 22 with weld projections 24 spaced on embossed portion 22. Embossed portion 22 of heater element 20 is attached as by welding at one end of top portion 14 of can 12. Heater element 20 extends in cantilever relation from the weld connection in a plane generally parallel to top portion 14 to a point near the opposite end of top portion 14. This placement of heater element 20 provides for a compact design whereby the height of can 12 can be kept at a minimum while using the embossed portion 22 for spacing the main portion of the heater element from the top portion of the can. A spherical projection 26 is provided in heater element 20 as by coining preferably about one quarter of the distance from the end welded to can 12 on the opposite side from the weld. This projection 26 acts as a positive stop for the bimetallic disk member 28 in the open contacts position to be discussed below.

The heater element 20 is formed of any one of a variety of materials of selected electrical conductivity so that the element is adapted to generate a predetermined amount of heat in response to a selected flow of electrical current therethrough. For example, heater element 20 may be formed of rigid cold-rolled steel to provide the element with stability and selected electrical heating characteristics. Alternately, heater elements of other rigid metals or the like used for providing the heater with different electrical properties are within the scope of this invention.

Figure 5:
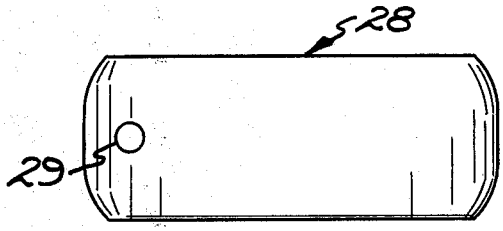
FIG. 5 is a plan view of a bimetallic member used in the switch of FIGS. 1–3.

A snap-acting bimetallic thermostatic disk member 28 as best shown in FIG. 5 has one end attached to the free end of heater element 20. A welding slug or projection 30 with a head portion 25 and a leg portion 27 is preferably used to electrically and physically connect member 28 to element 20 in cantilever fashion. Leg portion 27 fits through an aperture 29 in member 28 with the end portion 27 opposite head portion 25 welded to heater element 20. The use of plug 30 allows accurate positioning of bimetallic member 28 relative to heater element 20. Bimetallic member 28 is typically a dish-shaped element having one layer of metal of a low thermal coefficient of expansion and another layer of metal of a somewhat higher thermal coefficient of expansion so that upon heating and cooling of member 28 it will snap between a first closed position as shown by FIG. 1 and a second open position as shown in FIG. 2.

In accordance with this invention the width and length of bimetallic member 28 is essentially co-extensive with heater element 20 to provide for an accurately predictable "on" time and a protracted "off" time after the device has tripped due to the close proximity of all parts of the disk to the heater element. The devices relies primarily on radiation heating of the disk rather than conduction which can vary from device to device depending on the quality of connecting welds in the current path. The similar surface configuration of the heater element 20 and bimetallic member 28 with the closely controlled positioning of the element relative to the member by slug 30 allow for uniform radiation heating of the entire member 28. Thus, the "on" time can be accurately controlled and the "off" time is protracted because in the tripped condition the member is slow to cool due to being in contact with heater element at one point as shown in FIG. 3 and closely adjacent at all other points to receive radiation heating. The desirable feature of protracted "off" time allows the motor or the like this device is protecting to be able to cool sufficiently before being restrated again.

At the other end of bimetallic member 28 opposite slug 30, a movable contact 32 is attached as by welding. Movable contact 32 is formed of a material of high electrical conductivity such as silver and positioned so as to come into engagement with a stationary contact 34 when bimetallic member 28 is in the first closed contacts position. Stationary contact 34 is also formed of a material with high electrical conductivity preferably the same as movable contact 32.

Bimetallic member 28 is in a plane generally parallel and adjacent heater element 20 when in the second open contact position in contact with projection 26 to provide for compact design. The gap between the contacts 32, 34 in this second open position is kept to the minimum while not being so close to allow arcing current to jump the gap.

In accordance with invention stationary contact 34 is mounted on terminal pin 36 as by welding which in turn is mounted in a header plate 38 as shown in FIGS. 2 and 3. Terminal pin 36 is made from a material of high electrical conductivity such as an alloy comprising approximately 50% nickel and 50% iron.

Disk-shaped header plate 38 having a plan surface similar to the open ended bottom portion of can 12 has an aperture 40 in which pin 36 is secured in electrically insulated relation to the header plate 38 by means of an electrically insulating material such as glass 42. One end 37 of pin 36 extends external to the device for electrical connection to a circuit and the other end 39 extends into a switch chamber 44 to be discussed below. In addition an annular ceramic insulator 45 is preferably used to prevent arcing from pin 36 to header plate 38 across the glass 42 which can cause cracking or carbonization of the glass. Insulator 42 also stops arcing as a result of weld spatter. Insulator 42 is positioned with the bottom surface resting on top of glass sealant 42 and contiguous portions of header plate 38 and the top surface adjacent stationary contact 34 as seen in FIGS. 2 and 3. This positioning allows insulator 42 to provide both arc shield and arc shadow protection for the device.

The previously mentioned rim 18 of can 12 is welded in electrically conductive relation to header plate 38 to form the switch chamber 44 so that the thermally responsive electrical switch is completely sealed and pressure resistant.

With this construction, the switch is small and economically constructed with a minimal number of parts needed to display precisely predetermined thermal response properties. The device is rugged and inexpensive, is hermetically sealed and pressure-resistant, and is vibration-resistant so that the device does not tend to open or close a circuit inadvertently even when exposed to substantial vibrational forces.

Figure 6:
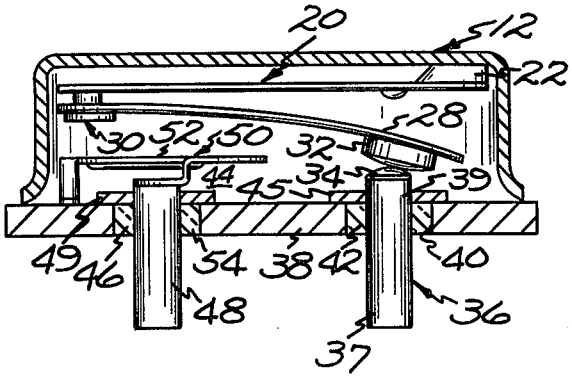
FIG. 6 is a sectional view similar to FIG. 2 of a second embodiment of the invention.
Figure 7:
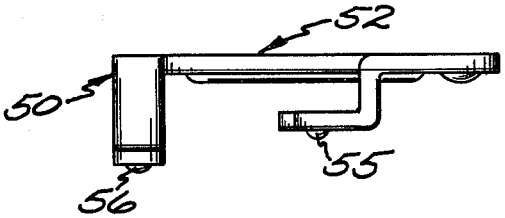
FIG. 7 is a front plan view of a second heater element used in the switch of FIG. 6.
Figure 8:
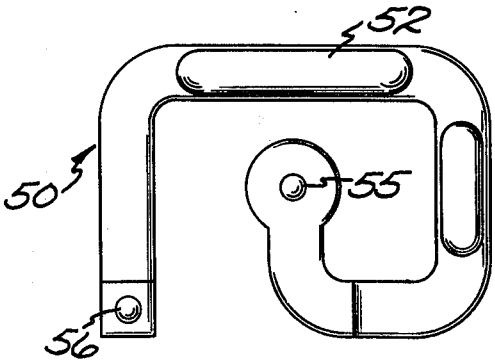
FIG. 8 is a top plan view of the second heater element of FIG. 7.

A second embodiment of this invention as shown in FIG. 6 is similar to the previously described device except an additional start winding heater 50, a terminal pin 48 and a second insulator 49 have been added. A second aperture 46 is present in header plate 38 in which the second terminal pin 48 is secured in insulated relation as by a glass seal 54. Second insulator 49 serves the same purpose as previously mentioned insulator 45. Start winding heater 50 as best shown in FIGS. 7 and 8 has a first end 55 attached to the top of pin 48 within chamber 44 and the second end 56 onto header plate 38. A top portion 52 having an inverted U-shape with an extension at one end extending toward the other end of heater 50 is positioned in a plane generally parallel the main winding heater element 20 but on the opposite side of bimetallic member 28 to provide for a compact design and efficient heating. The heat transfer from the two elements therefore primarily approach the bimetallic member 28 from opposite sides.

The calibration of either the first or second embodiment is easily done by deforming top portion 14 of can 12 after assembly at point C as shown in FIG. 1. The amount of deformation depends on the disk used and its positioning within the switch.

It should be understood that although particular embodiments of the switch have been described by way of illustration, modifications of structure could be made within the scope of this invention. This invention includes all modifications and equivalents of the illustrated embodiments of the inventions which fall within the scope of the appended claims.

I claim:

1. A thermostatic switch comprising a metallic casing having an open and closed end, a header plate having an aperture therethrough, said header plate welded to said open end to define a switch chamber, a terminal pin extending through said aperture and mounted in electrically insulated relation to said header plate, a stationary contact mounted on said terminal pin within said switch chamber, a heater element having a fixed and a free end, said element having the fixed end attached to said closed end of said casing and extending in cantilever relation therefrom, a snap-acting dish-shaped bimetallic member having two ends, at one end cantilever mounted to the free end of said heater element and at the other end carrying a movable electrical contact for movement between a first closed contact position and a second open contacts position with said stationary contact and an annular insulator positioned around said terminal pin adjacent to said stationary contact on one side and said header plate on the other.

2. A thermostatic switch as described in claim 1 in which said heater element and said bimetallic member have a width and length that are essentially coextensive with one another.

3. A thermostatic switch comprising a metallic casing having an open and closed end, a header plate having an aperture therethrough, said header plate welded to said open end to define a switch chamber, a terminal pin extending through said aperture and mounted in electrically insulated relation to said header plate, a stationary contact mounted on said terminal pin within said switch chamber, a heater element having a fixed and a free end, said element having the fixed end attached to said closed end of said casing and extending in cantilever relation therefrom, a snapacting dish-shaped bimetallic member having two ends, at one end cantilever mounted to the free end of said heater element and at the other end carrying a movable electrical contact for movement between a first closed contact position and a second open contacts position with said stationary contact, an annular insulator positioned around said terminal pin adjacent to said stationary contact on one side and said header plate on the other and a second heater element positioned parallel to said first mentioned heater element and on side of the bimetallic member opposite from said first mentioned heater element.

4. A thermostatic switch having a compact design comprising a metallic casing having an open end and a closed end with a top portion, a header plate having an aperture therethrough, said header plate hermetically attached to said open end to define a switch chamber, a terminal extending through said aperture mounted in electrically insulated relation to said header plate, a stationary contact mounted on said terminal within said switch chamber, a heater element having a fixed and a free end, said element having the fixed end attached to one end of said top portion and extending in cantilever relation therefrom in a plane generally parallel to said top portion, a snap-acting dish-shaped bimetallic member having two ends with one end cantilever mounted to the free end of said heater element and the other end carrying a movable electrical contact for movement between a first closed contacts position and a second open contacts position with said stationary contact, and an annular insulator positioned around said terminal adjacent to said stationary contact on one side and said header plate on the other.

5. A thermostatic switch comprising a metallic casing having an open and closed end, a header plate having an aperture therethrough, said header plate welded to said open end to define a switch chamber, a terminal pin extending through said aperture and mounted in electrically insulated relation to said header plate, a stationary contact mounted on said terminal pin within said switch chamber, a heater element having a fixed and a free end, said element having the fixed end attached to said closed end of said casing and extending in cantilever relation therefrom, a snap-acting dish-shaped bimetallic member having two ends, at one end cantilever mounted to the free end of said heater element and at the other end carrying a movable electrical contact for movement between a first closed contact position and a second open contacts position with said stationary contact, said bimetallic member is in a plane generally parallel to said first mentioned heater element when said member is in said open contacts position, an annular insulator positioned around said terminal pin adjacent to said stationary contact on one side and said header plate on the other, and a second heater element positioned parallel to said first mentioned heater element and on side of the bimetallic member opposite from said first mentioned heater element.

6. A thermostatic switch as described in claim 5 in which said first mentioned heater element and said bimetallic member have a width and length that are essentially coextensive with one another.

7. A thermostatic switch having a compact design comprising a metallic casing having an open end and a closed end with a top portion, a header plate having an aperture therethrough, said header plate hermetically attached to said open end to define a switch chamber, a terminal extending through said aperture mounted in electrically insulated relation to said header plate, a stationary contact mounted on said terminal within said switch chamber, a heater element having a fixed and a free end, said element having the fixed end attached to one end of said top portion and extending in cantilever relation therefrom in a plane generally parallel to said top portion, a snap-acting dish-shaped bimetallic member having two ends with one end cantilever mounted to the free end of said heater element and the other end carrying a movable electrical contact for movement between a first closed contacts position and a second open contacts position with said stationary contact, an annular insulator positioned around said terminal adjacent to said stationary contact on one side and said header plate on the other, and a second heater element positioned parallel to said first mentioned heater element and on side of the bimetallic member opposite from said first mentioned heater element.

8. A thermostatic switch comprising a metallic casing having an open and closed end, a header plate having an aperture therethrough, said header plate welded to said open end to define a switch chamber, a terminal pin extending through said aperture and mounted in electrically insulated relation to said header plate, a stationary contact mounted on said terminal pin within said switch chamber, a heater element having a fixed and a free end, said element having the fixed end attached to said closed end of said casing and extending in cantilever relation therefrom, and a snap-acting dish-shaped bimetallic member having two ends, at one end cantilever mounted to the free end of said heater element and at the other end carrying a movable electrical contact for movement between a first closed contact position and a second open contacts position with said stationary contact, said bimetallic member having a width and length essentially coextensive with said heater element.

9. A low cost thermostatic switch having a compact design comprising a deformable cup shaped metallic housing having an open end with a rim around it and a closed end with a generally flat top portion, a flat heater element having a fixed and a free end, said fixed end having an embossed portion for welding to said flat top portion disposing said heater in a generally parallel spaced relation to said top portion, a snap-acting dish-shaped bimetallic member having two ends with one end cantilever mounted to the free end of said heater element and the other end carrying a movable electrical contact for movement between a first and a second contact position and a header assembly comprising a header plate having an aperture, a header pin glass sealed within said aperture extending from each side of said plate in insulated relation to said plate, a stationary contact on an end of said header pin at one side of said header plate, and a ceramic insulator secured to said glass seal on said one side of said plate extending over said plate aperture, said header assembly being welded to said housing rim completely around said rim for supporting said stationary contact in compact selected position relative to said movable contact, whereby movement of said snap acting disc between said first and said second contact position is effective to make and break a circuit while provide a compact design.

* * * * *